United States Patent [19]

Davis et al.

[11] Patent Number: 5,041,309

[45] **Date of Patent: * Aug. 20, 1991**

[54] METHOD OF CHROMIZING A WORKPIECE BY APPLYING A COATING CONTAINING CHROMIUM PARTICLES ONTO A CERAMIC CARRIER, POSITIONING THE CARRIER PROXIMATE THE WORKPIECE, AND HEATING BOTH CARRIER AND WORKPIECE TO DIFFUSE CHROMIUM PARTICLES INTO THE WORKPIECE

[75] Inventors: Thomas L. Davis, Louisville; Dale F. LaCount; Steven E. LeBeau, both of Alliance, all of; Kenneth D. Seibert, Hemet, Calif.

[73] Assignee: The Babcock & Wilcox Company, New Orleans, La.

[ * ] Notice: The portion of the term of this patent subsequent to Feb. 27, 2007 has been disclaimed.

[21] Appl. No.: 486,481

[22] Filed: Feb. 28, 1990

[51] Int. Cl.[5] ..... B05D 7/00

[52] U.S. Cl. ..... 427/217; 427/239; 427/253; 427/319; 427/374.2; 427/376.8; 427/398.1

[58] Field of Search ..... 427/376.6, 253, 229, 427/232, 239, 217, 319, 374.2, 376.8, 398.1; 228/194, 245

[56] References Cited

U.S. PATENT DOCUMENTS

| | | | |
|---|---|---|---|
| 3,775,151 | 11/1973 | Baker et al. | 427/253 |
| 3,918,623 | 11/1975 | Ishiguro et al. | 228/194 |
| 4,009,146 | 2/1977 | Cork et al. | 427/229 |
| 4,208,453 | 6/1980 | Baldi | 427/237 |
| 4,228,203 | 10/1980 | Yogi et al. | 427/229 |
| 4,290,391 | 9/1981 | Baldi | 122/511 |
| 4,332,843 | 6/1982 | Ahuja | 427/253 |
| 4,427,720 | 1/1984 | Gouje | 427/253 |
| 4,687,684 | 8/1987 | Restall et al. | 427/253 |
| 4,830,931 | 5/1989 | Baldi | 427/253 |
| 4,904,501 | 2/1990 | Davis | 427/253 |

*Primary Examiner*—Shrive Beck
*Assistant Examiner*—Benjamin L. Utech
*Attorney, Agent, or Firm*—Vytas R. Matas; Robert J. Edwards; Daniel S. Kalka

[57] ABSTRACT

An improved method of diffusion coating a workpiece, such as ferritic tubing employing a ceramic carrier provided with a diffusion composition. The diffusion composition includes a diffusion element such as chromium, silicon, aluminum, and boron. The carrier is subjected to an elevated diffusion temperature in a controlled environment to diffusion coat either the external or internal surface of the workpiece.

17 Claims, 4 Drawing Sheets

(a) AS-RECEIVED 4130 TUBE OUTER I.D.

100X
NITAL ETCH (b) O.D. RUN 1 - TUBE 2

100X
NITAL ETCH (a) 2-1 I.D. OF OUTER TUBE 100X
2% NITAL ETCH (b) 2-1 O.D. OF INNER TUBE

100X

METHOD OF CHROMIZING A WORKPIECE BY APPLYING A COATING CONTAINING CHROMIUM PARTICLES ONTO A CERAMIC CARRIER, POSITIONING THE CARRIER PROXIMATE THE WORKPIECE, AND HEATING BOTH CARRIER AND WORKPIECE TO DIFFUSE CHROMIUM PARTICLES INTO THE WORKPIECE

BACKGROUND OF THE INVENTION

This invention relates to an improved method for diffusion coating of surfaces such as chromizing ferritic surfaces and, more particularly, the interior and exterior surfaces of steel boiler tubes, pipes and like components, particularly small bore tubing.

Chromizing is a process used to produce a high chromium surface layer on iron or steel by high temperature heating of a solid packing material containing chromium powder. This process is used on boiler tubes, pipes, and other components, like boiler components, to provide a surface which is resistant to exfoliation, i.e., high temperature oxidation with subsequent breaking away or loss of the oxide layer. Boiler components are often chromized by a process known as pack cementation. This processing technique has been widely used throughout industry for many years.

In the pack cementation process, a pack mixture comprising chromium, an inert filler (e.g., alumina) and a halide activator (e.g., ammonium chloride) are blended together. The boiler component to be treated, i.e., the tubing or pipe, is filled with the mixture. The component is then loaded into a controlled atmosphere retort or sealed by the welding of caps to its ends to produce a self-contained retort. The entire assembly is heated to an elevated temperature and held for a specified length of time to allow the desired chemical reactions and subsequent diffusion process to occur. The high chromium content surface layer is formed on the surface of the component by diffusion of chromium into the iron. The component is then cooled to room temperature. The used pack mixture is removed from the interior. The component is then subjected to a post process cleaning step. The end result of this process is a relatively thick (equal or greater than 0.002 inches) chromium diffusion coating on the internal surface of the tubular boiler component.

This process technique has proven to be effective for chromizing boiler components. However, it has several inherent disadvantages. For example, the mix preparation, loading, and removal steps are tedious and time consuming. The gravity loading techniques, which are typically employed for filling elongated tubular components, require shop areas with high ceilings or floor pits, or both, to accommodate components as long as 30 feet in length.

In addition, it is difficult to control pack mix density and composition a long the length of the small bore of tubular components (e.g., less than one inch internal diameter) with normal gravity filling techniques. Mix removal and post process cleaning can also be a problem in small bore tubes. Moreover, diffusion thermal cycles are relatively long due to the poor thermal conductivity of the pack mix. Finally, large quantities of pack mix can be required since the internal cavity of the component to be chromized must be filled, and this is quite expensive.

Therefore, a need exists for an improved method of diffusion coating particularly as relates to chromizing of boiler tubing. Moreover, a general technique for chromizing as well as applying diffusion coatings of other elements, for example, silicon, aluminum and boron, to various configurations and shapes would have significant advantages and widespread application.

SUMMARY OF THE INVENTION

The invention comprises an improved method for diffusion coating of the surfaces of workpieces including, but not limited to, the inside and outside surfaces of tubular components and, as well, configurations with other than tubular geometries.

The inventive techniques comprise providing a ceramic carrier and applying a coating or impregnation composition to the carrier which includes one or more elements which are to be diffused into the workpiece. The carrier, after being coated or impregnated with the applied composition, is subjected to an elevated temperature in a controlled environment with the workpiece for a sufficient time to cause the element to diffuse onto and coat the workpiece.

A chromium containing pack mixture is produced in a form which can be inserted into the internal cavity of the tubing. The pack mixture form, in one embodiment of the invention, comprises inserts like pellets or slugs which are inserted directly into the tubing and, in an alternate embodiment, the pack mixture is blended into a slurry then coated on an inert refractory container, for example, in the form of a spun alumina blanket, braided sleeve, or ceramic insert, or impregnated within a formed sleeve.

The slurry is composed of a blended mixture of chromium, alumina, vehicle and binder. In some applications, the halide activator is omitted from the insert and separately placed into the component which is to be chromized.

Another aspect of the invention comprises providing elongated ceramic solid inserts which contain the required chromium particles and other ingredients to facilitate chromizing of the tubing. The chromium containing solid inserts and the tubing to be chromized are preheated for a desired amount of time and the insert placed into the tubing. Thereafter, an activator is added to the tubing. The tubing is then prepared, by sealing the ends, and subjected to a normal pack cementation thermal cycle.

The inserts, in accordance with further aspects of the inventive technique, comprise ceramic fiber cylinders, either impregnated or coated with chromium, or vacuum-formed ceramic fiber sleeves coated with a slurry containing chromium.

Inserts made in accordance with the invention can be readily loaded into the tubing by hand, without the use of a crane, in the horizontal position. After the chromizing step, the inserts can be easily removed, resulting in minimal clean-up requirement. The use of the insert significantly reduces the quantity of chromium required as compared to the pack cementation technique.

It is an object of the invention to provide an improved alternative to the conventional pack cementation technique of chromizing either the interior or exterior surfaces of ferritic tubing.

The various features of novelty which characterize the invention are pointed out with particularity in the claims annexed to and forming part of this disclosure. For a better understanding of the present invention, and the operating advantages attained by its use, reference is made to the accompanying drawings and descriptive matter in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION OF THE PREFERRED EMBODIMENTS

Figure 1:
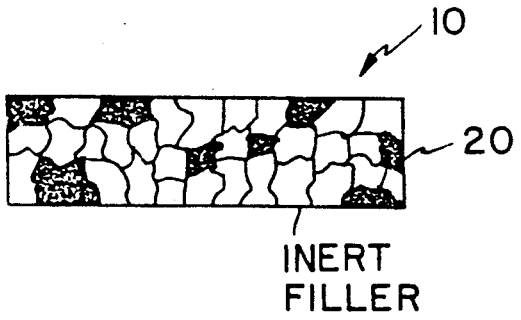
FIG. 1 is a longitudinal schematic perspective of an embodiment of the present invention as a coarse grain slug.
Figure 2:
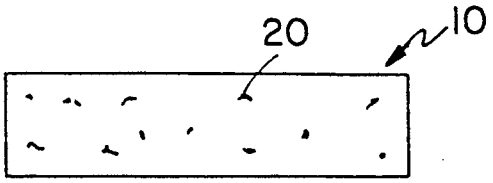
FIG. 2 is similar to FIG. 1 except in this embodiment it is a fine grain slug.

In the embodiments depicted in FIGS. 1-6 of the present invention, inserts in the form of slugs or pellets 10, continuous sticks 12, prefabricated strings 14, coated inert shells 16 and layered shells 18, insertable into a tubing to be treated, are fabricated from a slurry mix.

Raw materials used to provide the slurry mix include a diffusion coating material 20, such as chromium or other metal to be diffused, alumina, a liquid vehicle, e.g., water, a binder of methyl cellulose or ammonium alginate, and a halide activator such as ammonium chloride, sodium chloride or ammonium bromide. When chromium is employed, it is preferably electrolytic grade chromium and is provided, in powdered form, ≦100 mesh, in an amount of at least 10 percent, by weight, of the slurry mix. The alumina, which functions as an inert filler, is preferably tabular alumina grade T-61, available from ALOCA, ≦100 mesh, and is also provided in an amount of at least 10 percent, by weight, of the slurry mix. The water is provided in an amount of at least 12 percent by weight of the slurry mix. The binder is present in an amount of about 2 percent by weight of the water. Halide activator, in powdered form, is provided in an amount of no greater than 14 percent by weight of the slurry mix or at least greater than or equal to 0.25 grams per square inch of the area of the tubing surface to be diffusion coated.

Figure 4:
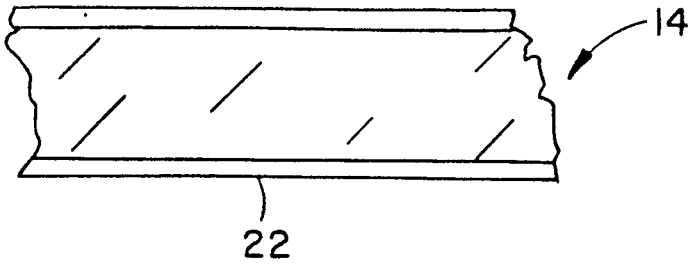
FIG. 4 is similar to FIG. 3 yet still is another embodiment wherein the slurry mix is in the form of a prefabricated string within an inert shell.

In some applications, an inert refractory container 22 in the form of a woven inert or refractory-type material such as a spun KAOWOOL alumino-silicate fiber in the form of a braided sleeve or string 14 may be used to contain the solidified form as best illustrated in FIG. 4.

The slurry mixture is prepared by blending the diffusion metal, e.g., chromium, inert filler, and the halide activator, with a premixed solution of the water and binder, utilizing standard mixing equipment to form a relatively viscous slurry (≧40% solids).

Figure 3:
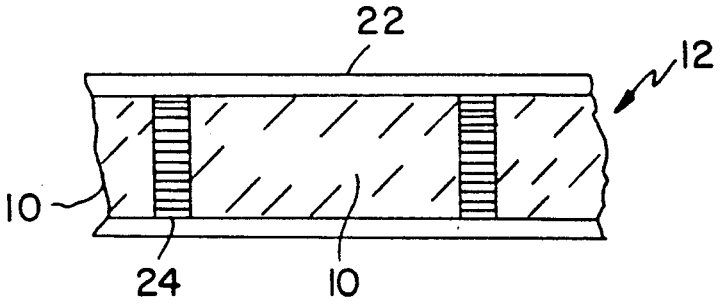
FIG. 3 is a longitudinal sectional illustration of an alternate embodiment of the present invention wherein the slug is contained in an outer inert shell.

The solidified shapes, such as pellets or slugs 10, can be prepared by using standard pelletizing equipment. The pellets or slugs 10 in the preferred embodiments have a diameter of less than or equal to one inch and a length of less than or equal to three inches. The pellets may be loaded directly into the internal cavity of a tube for chromizing. Alternatively, the pellets can be loaded into an external sleeve of a woven, inert material 22 prior to insertion into the tube (not shown) to be chromized as is depicted in FIG. 3. The outer shell 22 is an inert material such as a refractory or a ceramic. The prefabricated slug 10 is situated therein. A prefabricated activator slug 24 which may consist of a different coating metal 20 is staggered between the prefabricated slugs 10 within the inert shell 22.

Other elongated solidified inserts can be produced by extruding the slurry mix such as a prefabricated string 14 in FIG. 4.

Subsequent to formation, the inserts 10, 12, 14, 16 and 18 are cured by heating in an atomospheric furnace to a temperature between 150° and 250° F. for a period of at least two hours. The inserts are allowed to cool to room temperature before subsequent usage.

Preformed refractory objects, 16, 18 referred to hereafter as a ceramic carrier, in accordance with the present invention, are provided with elements, such as chromium particles and other ingredients, which are to be diffusion coated onto a workpiece. The ceramic carrier 16, 18 is associated with the workpiece in a controlled environment, for example, by loading both into a retort and sealing the retort, and subjected to high (refractory-range) temperatures for a sufficient time period to cause the element to diffuse into and coat the surface of the workpiece.

The carrier 16, 18 in accordance with a preferred embodiment of the invention comprises a ceramic fiber composition, such as an alumino-silicate fiber such as, KAOWOOL, a registered trademark of The Babcock & Wilcox Company. Such inorganic fibers are made from blowing a molten kaolin stream, as is well-known, and are typically formed into blankets or other general forms which are used for thermal insulation in heat treating furnaces, molten metal systems, and like applications. Vacuum forming processes which involve suspending the fibers in a liquid slurry and then evacuating the slurry under a vacuum through a fine mesh screen shaped to form a desired configuration can also be used for forming the carrier. Such ceramic fiber tubes, sleeves, and boards are often vacuum formed for the foundry and steel industry as molten metal feeding aids (risers or hot tops). Ceramic carriers 16, 18 containing the diffusion elements in the form of particulates can be made by adding the particulates to the fiber slurry and then vacuum forming the carrier from the mixture.

Alternatively, a ceramic carrier in the form of a ceramic fiber sleeve or other shapes may be made for diffusion coating by vacuum forming a slurry of the fibers and the particles of the element to be diffused, by taking a ceramic fiber sleeve and then painting, dipping or spraying a slurry mixture of the particles onto the sleeve, or by rolling up a ceramic blanket to form a sleeve and then painting this sleeve with a diffusion element or putting the particles into the mid-wall of the blanket by peeling apart the wall of the blanket, or by extruding a slurry of the fibers and the particles of the element to be diffused into a desired shape followed by an elevated temperature firing operation to drive off the low temperature volatile constituents from the liquid slurry.

Thus, in accordance with the preferred embodiment of the present invention, there is an insert composed of a ceramic material with a composition containing chromium particles.

Figure 5:
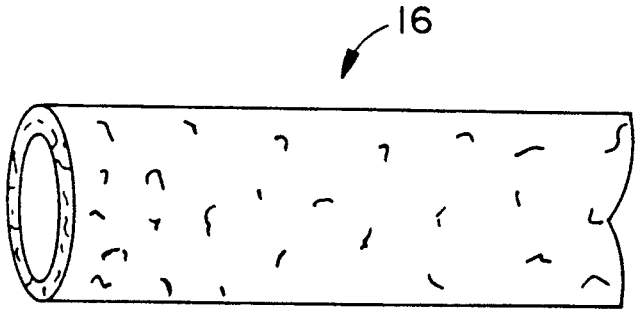
FIG. 5 is a longitudinal schematic perspective view of part of a cylindrical ceramic fiber insert containing chromium particles on its surface for use in accordance with the method of the invention.

In the embodiment of the invention illustrated in FIG. 5, the insert, designated generally at 16, has a cylindrical configuration. However, it will be appreciated by those skilled in the art that the concept of the invention is equally applicable to the use of elongated elements in hollow tubular form, to solid cylinders, to multilayered concentric elements and to other elongated forms.

The insert 16 may be comprised primarily of inorganic fibers, particularly highly refractive fibers composed wholly of alumina and silica, or primarily of alumina and silica.

Figure 6:
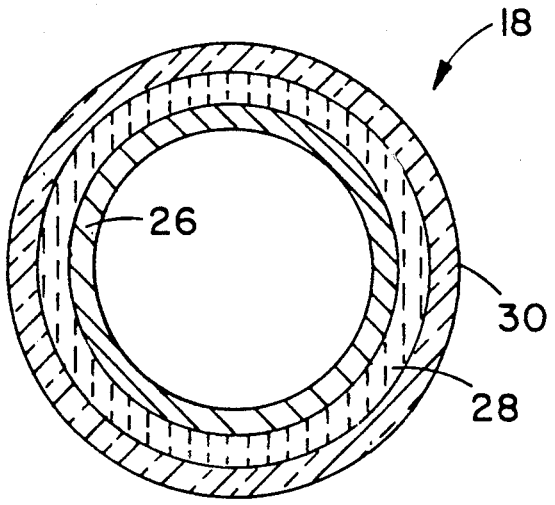
FIG. 6 is a cross-sectional schematic illustration of a multilayer cylindrical ceramic fiber with a mid-section containing chromium particles.

The insert 16 is provided with chromium particles 20 which initially were contained in an aqueous composition which was applied to the insert 16. For example, the ceramic fiber cylinder can be either impregnated or the outer surface coated with a chromium containing composition. Alternatively, as shown in FIG. 6, an insert 18 is formed of three layers 26, 28, 30. The outer layer 30 is designed to prevent direct contact of chromium with the internal surface of the ferritic tubing which is to be chromized in order to eliminate adherence of the chromium particles. The inner layer 26 has a higher density so as to be less permeable than the outer layer 30, thereby causing the chromium 20 contained in the middle layer 28 to diffuse through the outer layer 30 toward the surface of the tubing (not shown) which is to be chromized.

The following examples are illustrative and explanatory of the invention. All percentages are expressed as weight percentages unless otherwise indicated.

EXAMPLE I

The slurry mixture is prepared by blending the chromium, inert filler, and the halide activator to a premixed solution of the water and binder resulting in a relatively viscous fluid suspension. In some instances, it may be desirable to omit the halide activator from this combination. When layered coatings are employed in this technique, the separate slurries eg. chromium based or aluminum based are prepared. Standard mixing/agitation equipment is used in preparing these slurries.

The aqueous compositions used in this example are each prepared by adding ammonium alginate (SUPERLOID, made by Kelco Co.) to water, mixing the solution, and by blending chromium (8–20 mesh electrolytic chromium,) alumina (8–20 mesh ALOCA tabular alumina -T61) and ammonium chloride in powered form into the solution to form the relatively viscous aqueous slurries of Table 1.

Inserts can be formed in a variety of ways including standard pelletizing equipment. For this example, solid slugs of the compositions given in Table 1 were poured in a tube having end caps. The capped tube was evaluated in the retort concept.

The slurry mix was in the form of cylindrical pellets about ½ inch in diameter and about ¾ inch long.

TABLE 1

| Slurry Specimen | Chromium (%) | Alumina (%) | Ammonium Chloride (%) | Ammonium Alginate (%) | Water (%) |
|---|---|---|---|---|---|
| 1 | 14.52 | 58.10 | 14.52 | 0.26 | 12.60 |
| 2 | 11.56 | 46.90 | 11.56 | 0.87 | 29.11 |

TABLE 2

| Slurry Specimen | Chromizing Thermal Cycle Temp. (°F.) | Time (hrs) | Atm. | Calculated Chrome Potential (gm/in2) |
|---|---|---|---|---|
| 1 | 2000 | 1 | Ar | 0.32 |
| 2 | 2000 | 1 | Ar | 0.33 |

Experimental test results have indicated that chromium must be present in the slurry mix to provide a chromium potential within the range of 0.3 to 2.0 grams per square inch of surface to be chromized. The best results appear to be obtained when chromium potential is equal to or greater than 0.7 grams per square inch.

If a dry activator is added to inserts when loaded into a tube such as is depicted in FIG. 3, the hygroscopic nature of the preferred activator requires there not to be an excessive delay between loading of the inserts into the components to be chromized and initiation of the diffusion coating thermal cycle.

EXAMPLE II

The outer surface of a quantity of two-inch internal diameter cylindrical ceramic sleeves 12-inches long and having a wall thickness of 1/20 inch were coated by brushing a chromium rich suspension thereon and drying the sleeves to produce chromium contents of 100 gm Cr per linear foot (0.75 gms Cr per square inch of internal surface for a 3-½ -inch internal diameter tube) and 400 gm Cr per linear foot (3.0 gms Cr per square inch of internal surface for a 3-½ -inch internal diameter tube). Two of the sleeves were wrapped in a thin (0.020-inch) KAOWOOL brand alumina-silicate sheet to determine if providing a physical barrier between the tube to be chromized and the chromium particles would improve tube clean up after thermal cycles were performed.

Each insert was inserted into a length of 3-½ -inch, schedule 40, CROLOY 2-¼ (ASTM A-335, Grade P-11) pipe which had been grit blasted to provide a clean inner surface. The pipe and insert were preheated to about 180 degrees F prior to inserting the insert. An activator was added to the pipe. The pipe was sealed and evacuated. The combined pipe and insert were then heated to 2200° F., maintained at such temperature for two hours, and cooled to room temperature.

The results are illustrated in the Table 3.

The tabulated results and examination of photomicrographs of the specimens indicate that the lower chromium content (0.75 gm Cr/in$^2$ of tube I.D. surface)

produced a total chromized layer of about 2.5 mils in thickness. The increased activator concentration (54 grams vs. 36 grams $NH_4Br$) did not produce any observable differences in the chromized layer thickness. In addition, the presence of the thin outer wrap of KAOWOOL alumina-silicate paper (0.020") did not produce any noticeable differences in the chromized layer thickness with the low chromium content sleeves.

Tubes that were chromized with the ceramic inserts containing a higher chromium content (3 gm Cr/in$^2$ of tube I.D. surface) produced chromized layers which ranged from 6.5 to 10 mils with a carbide layer of 0.25 to 0.50 mils in thickness. The chromized layers produced during these trials appear metallographically identical to those produced by the standard pack cementation mix processes.

TABLE 3

| Trial No. | Speciman No. | Chromium* | Activator Type | Activator Wt (gms) | Kaowool Outer Wrap | Pipe Location | Chromized Thickness Carbide | Layer (Mils) Total |
|---|---|---|---|---|---|---|---|---|
| 1 | 1 | 0.75 | $NH_4Br$ | 36 | no | A | T-¼ | 2-2.5 |
| 1 | 2 | 3.0 | $NH_4Br$ | 36 | | B | T-1/14 | 2-2.5 |
| | | | | | yes | A | ¼ | 6/5-7 |
| | | | | | | B | ¼ | 7-8 |
| 2 | 1 | 3.0 | $NH_4Br$ | 36 | no | A | ¼ | 7-8 |
| | | | | | | B | ¼-½ | 9-10 |
| | | | | | | C | T-¼ | 5.5-6 |
| | | | | | | D | T-¼ | 6-7 |
| 2 | 2 | 0.75 | 65 | 65 | yes | A | T-¼ | 2-2.5 |
| | | | | | | B | T-¼ | 2-2.5 |

gm/in$^2$ of internal surface for a 3½ inch diameter tube

EXAMPLE III

A slurry was formed from a composition composed of 1600 ml of 2% METHOCEL methylcellulose in distilled water, 500 gms of alumina powder and 800 gms of ALOCA grade 129 aluminum powder.

Two low alloy steel (Grade 4130) tubes were arranged in spaced, concentric relationship; the inner tube being 2-⅜" OD by 0.147" wall placed inside an outer tube 3-½" OD by 0.254" wall. A 1/16-inch thick layer of the slurry was applied by brushing slurry onto the outside diameter of a 12-inch long inner tube (only) which has been preheated as in Example I. The application of a 1/16 inch thick layer results in an effective coverage of aluminum powder at 0.3 gram per square inch of surface area to be coated. As in Example I, an activator was added ($NH_4Cl$) and the pipe sealed and evacuated; the pipe was then heated to 1775° F. for three hours followed by a slow furnace cool to room temperature accomplished by shutting off power to the furnace. Subsequent metallurgical examination of the outside diameter surface of the inner tube disclosed an aluminized coating thickness of 5 to 7 mils. In a second case, a 150 inch thick layer of the slurry composition was placed on the outer surface of a 12 inch long 2-⅜" OD inner tube to produce an effective coverage of aluminum powder of 0.7 gram per square inch of surface area to be coated. This inner tube was also arranged in spaced, concentric relationship inside a larger 3-½" OD by 0.254" wall tube and subjected to the same thermal cycle stated in the first case above (1775° F. for 3 hours followed by a furnace cool to room temperature). An aluminized coating thickness of 7 to 9 mils was formed on the outside diameter surface of the inner tube for the second case.

In both of the cases cited above, in addition to a uniform diffusion coating layer adjacent to the steel tube surface, a heavier excess layer (referred to as a "sintered layer") was evident which appears to be unreacted excess aluminum. The thickness of this excess unreacted aluminum layer ranged from 5 to 7 mils for the first case and from 5 to 20 mils for the second case. Increasing the time held at the 1775° F. temperature would most likely convert more of this excess unreacted layer resulting in a subsequent increase in the aluminum diffusion coating thickness. Increasing the available aluminum during the coating process from 0.3 gm per square inch for Case #1 to 0.7 gm per square inch produced a slight improvement in the coating thickness achieved but also resulted in an increased amount of excess unreacted aluminum. It would appear that a lower level of available aluminum (0.3 gm/in$^2$) is sufficient to achieve acceptable aluminum diffusion coating thicknesses.

EXAMPLE IV

The standard thermal cycles used for aluminum diffusion coating applications, (such as that used in Example III), employ an elevated temperature 1700°-1900° F. cycle to promote the formation of aluminum halide vapors and subsequent diffusion of aluminum into the surface being coated. When coating carbon or low alloy steels, this elevated temperature cycle produces a solid state phase transformation in the steel and growth of the individual crystals or grains of the steel. These physical changes in the steel substrate produce a reduction of the mechanical strength of the steel substrate. The deterioration of the steel substrate's mechanical properties resulting from conventional aluminizing treatments generally restricts aluminized materials to applications where the steel substrate mechanical properties are restricted to lower levels. In some cases, alonized material is given a heat treatment after aluminizing to attempt to improve the mechanical properties of the steel substrate. This additional heat treatment increases the processing costs to produce the end product which in some cases may make aluminizing economically unattractive.

To evaluate the potential for aluminizing steel substrates without degrading the steel's mechanical properties, attempts were made to produce aluminized coatings on steel substrates by employing a lower thermal cycle (1275° F.-1300° F.) for a longer time (24 hours). In the first case, a slurry was formed from a composition of 32 gms of aluminum powder, 110 gms of colloidal silica solution and 1 gm of METHOCEL.

A total of 104 gms of the mix, in which the aluminum powder was ALOCA 1401 aluminum powder was coated onto the outer surface of the inner tube and the inner surface of the outer tube, each of which were 6 inches long, at 100 gms/foot (0.5 gms/in$^2$). As in Example III, activator was added and the tubes sealed and evacuated; and then heated at 1275°-1300° F. for about 24 hours followed by a furnace cool to room temperature. The resulting aluminized coating thickness was 1 to 2 mils.

In a second case, ALOCA 718 Grade Al-12% silicon alloy powder was substituted for the ALOCA 1401 pure aluminum powder. It was speculated that an alloy of aluminum plus silicon with a lower melting temperature than a pure aluminum powder would provide a more active aluminum halide atmosphere at the 1275°-1300° F. temperature range which would enhance the aluminizing process kinetics. The same process parameters were used for this second case with the exception of the substitution of the ALOCA 718 Grade Al-12 silicon powder for the pure aluminum ALOCA 1401 grade. The use of the Al-Silicon powder did not produce any measurable layer of vapor deposited coating on the steel substrate. Although the exact cause for this failure to produce a coating was not determined, the Silicon addition apparently interferes with the formation of the aluminum halide species either by dilution of the total available aluminum at a fixed amount of alloy powder or by a chemical interaction with the halide activator.

Figure 7:
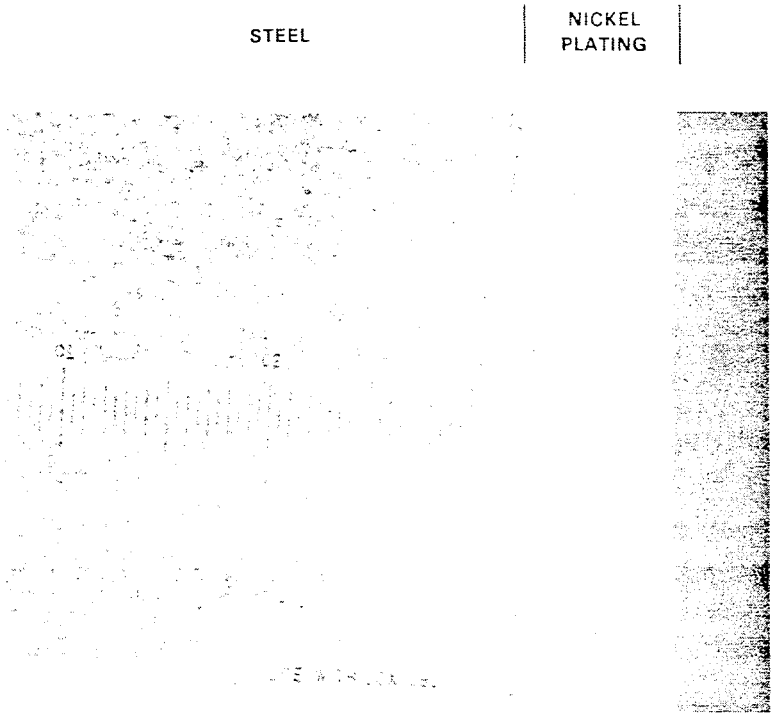
FIG. 7 is a photomicrograph of as-received 4130 steel material.
Figure 8:
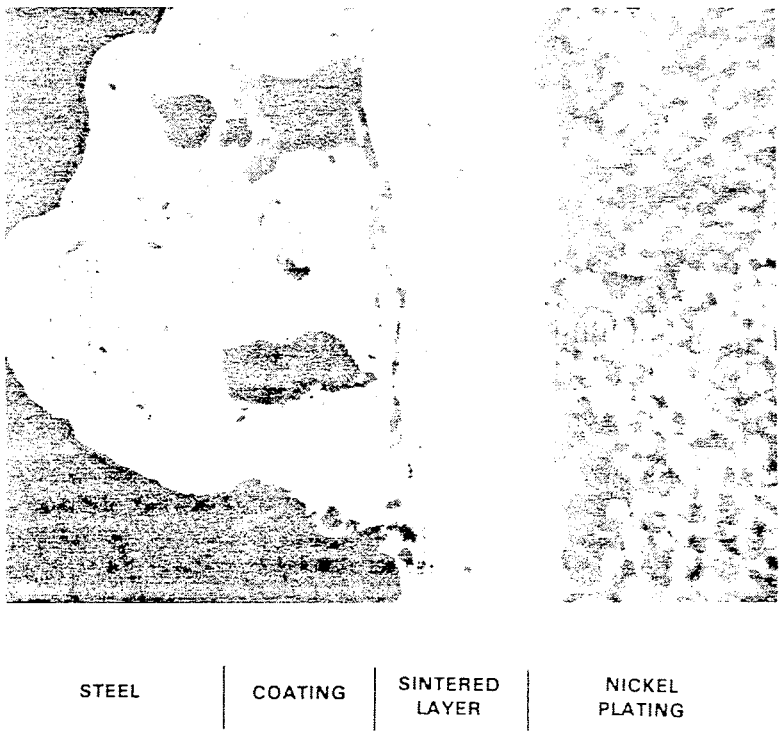
FIG. 8 is a photomicrograph of this material after a conventional high-temperature (1700°-1900° F.) aluminizing treatment.
Figure 9:
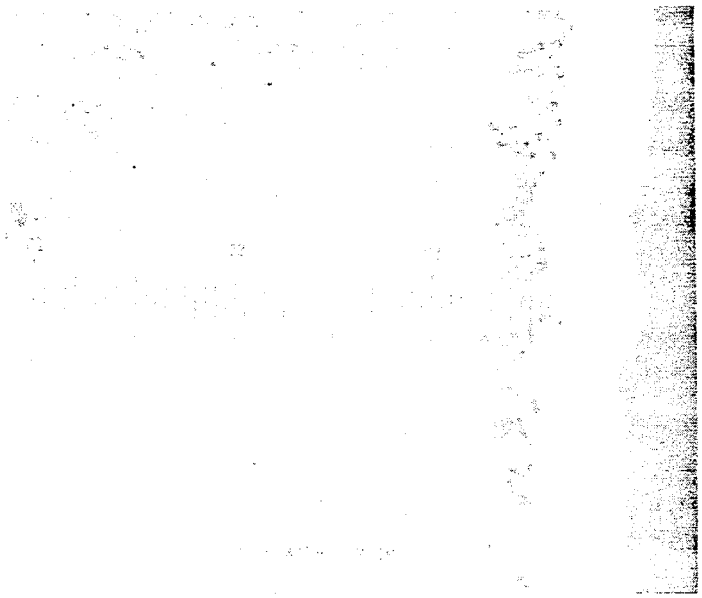
FIG. 9 is a photomicrograph of the inner diameter of an outer tube of this material after the lower temperature aluminizing treatment.
Figure 10:
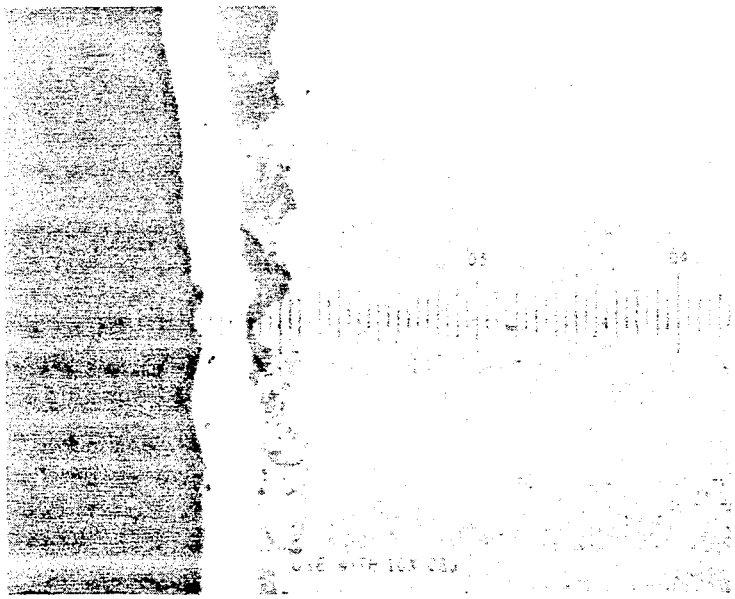
FIG. 10 is similar to FIG. 9 but is the outer diameter of the inner tube.

The use of a lower temperature (1275°-1300° F.) thermal cycle for this Example was designed to minimize a change in the mechanical properties of the steel substrate. FIGS. 7-10 compare the microstructure of the 4130 steel material. FIG. 7 shows the microstructure of the as-received 4130 tubing. FIG. 8 is after a conventional high temperature (1700°-1900° F.) aluminizing treatment. FIGS. 9 and 10 are after the lower temperature aluminizing treatment. All of these photomicrographs are at the same magnification. Examination of the steel substrate in each figure reveals that the conventional aluminizing treatment in FIG. 8 results in substantial grain growth in the steel substrate. Whereas in FIGS. 9 and 10 the steel substrate subjected to the lower temperature thermal cycle is very similar to the as-received steel substrate (FIG. 7) in microstructural characteristics. The lack of any substantial grain growth in the steel substrates subjected to the lower thermal cycle indicates that the mechanical properties of these steel substrates should be at or near the levels present in the as-received tubing. Although the aluminized coating thickness obtained at the 1275°-1300° F. treatment is much lower (1 to 2 mils) than the standard treatment (5-9 mils) the aluminized coating appears to be uniform in coverage and should provide a corrosion protective barrier to the steel substrate which may be acceptable for many applications.

EXAMPLE V

A demonstration was performed using a preformed refractory sleeve (e.g. objects 16, 18 in FIGS. 5 and 6) by the use of a vacuum formed sleeve containing aluminum powders suspended in the refractory sleeve.

The refractory sleeve insert was vacuum formed into a 2×178 inch diameter tubular sleeve from a batch composition comprising 50% ALOCA 1401 aluminum, 47.50% Bulk D fiber and 0.15% LUDOX colloidal silica with starch added in sufficient quantities to flocculate the aluminum powder to the fiber. The sleeve was dipped in a rigidizer (colloidal silica) dried at 125° F. and was found to have a density of 24 to 25 pounds per cubic foot, and an aluminum content of about 100 gm/ft. (0.5 gm/in$^2$).

The sleeve was placed in between the two concentric tubes into which an activator was placed and the tubes sealed as in Examples III and IV. The tubes were heated at 1275°-1300° F. for about 24 hours followed by a furnace cool to room temperature. Thereafter, the inner surface of the outer tube was found to have an aluminized thickness of 1 to 1.5 mils and the outer surface of the inner tube was found to have an aluminized thickness of 0.5 to 1.0 mils.

This example demonstrates that a refractory carrier with metal powder suspended in the carrier can be used directly as a substitute for a slurry application without any required changes in the aluminizing process parameters.

To compare the refractory carrier sleeve method employed for Example V, Case 1, a duplicate sample prepared via the slurry method was subjected to the same thermal cycle simultaneously as Example V, Case 1. The slurry used for the Example V, Case 2 was prepared in precisely the same method as the sample cited in Example IV, Case 1 using pure aluminum powder applied directly to the tube surfaces. This slurry/substrate configuration was subjected to a 1275°-1300° F., 24 hour cycle simultaneously with Example V, Case 1. An aluminized surface of ½ to 1 mil resulted although the coating coverage was somewhat nonuniform.

The inconsistent coating coverage obtained in Example V, Case 2 as well as the inability to coat the steel substrate in Example IV, Case 2 suggest the experimental conditions chosen for Examples IV and V might be near a threshold where slight deviations in available aluminum content produce inconsistent coating response. The use of higher levels of available aluminum and/or activator for the lower temperature thermal cycle may be required to insure reproducible results.

The test conditions used for Examples III, IV and V are summarized in Table 4. The results of the experimental trials cited in Examples III, IV and V are illustrated in Table 5.

TABLE 4

TEST CONDITIONS FOR ALUMINIZING TRIAL SERIES*

| Example # | Case # | Al Content gm/foot (gm/in$^2$) | Application Method | Thermal Cycle |
|---|---|---|---|---|
| 3 | 1 | 62 (0.3) | Slurry On | 1775° F. - 3 Hrs; |
| 3 | 2 | 151 (0.7) | Inner Tube Only | Furnace Cool |
| 4 | 1 | 100 (0.5) | Slurry On | 1275°-1300° F. - 24 Hrs; |
| 4 | 2 | 100 (0.5) (Al-12 Si Powder) | Both Tubes | Furnace Cool |
| 5 | 1 | 100 (0.5) | Sleeve from IPD** | 1275°-1300° F. - 24 Hrs; |
| 5 | 2 | 100 (0.5) | Slurry on Both | Furnace Cool |

TABLE 4-continued

| TEST CONDITIONS FOR ALUMINIZING TRIAL SERIES* | | | | |
|---|---|---|---|---|
| Example # | Case # | Al Content gm/foot (gm/in$^2$) | Application Method | Thermal Cycle |
| | | | Tubes | |

*36 gms $NH_4Cl$ Activator used for all tests.
**Insulated Products Division

TABLE 5

| RESULTS OF ALUMINIZING TRIALS | | | |
|---|---|---|---|
| Example # | Case # | Aluminized Coating Thickness (Mils) | Excess Sintered Al Layer (Mils) |
| 3 | 1 | 5-7 | 5-7 |
| 3 | 2 | 7-9 | 5-20 |
| 4 | 1 | 1-2 | 1-2 |
| 4 | 2 | — | — |
| 5 | 1 outer tube | 1-1.5 | 2-3 |
| | 1 inner tube | 0.5-1.0 | — |
| 5 | 2 | ½-1 but non-uniform coating coverage | |

The foregoing examples are not intended to be limiting in how the invention can be practiced. Although the process described above pertains to diffusion coating the internal surface of tubular shapes with chromium and aluminum, it should be understood that the method of the present invention may also be used for applying diffusion coatings of other elements (e.g., silicon, boron) or combinations thereof, for the outside diameter as well as the inside diameter, and for configurations other than tubular geometries such as solids, rectangles, etc. Although kaolin ceramic fiber preforms have been tested, inorganic fibers from other minerals may be used and preforms from nonfibrous ceramics, such as porous insulated firebrick. The preforms need not be hollow in shape for use in tubing, and in fact for small tubing, small solid, cylinders may be preferred for preforms due to ease of manufacture.

We claim:

1. An improved method of chromizing a ferritic tube comprising the steps of:

providing an elongated ceramic carrier;

applying an aqueous coating composition to the carrier, the coating composition comprising chromium particles which are to be diffused into the ferritic tube;

positioning the chromium containing carrier proximate to the ferritic tube; and subjecting the carrier to an elevated chromizing temperature to diffuse the chromium particles into the ferritic tube.

2. An improved method of chromizing a ferritic tube, as set forth in claim 1 further comprising the step, prior to said positioning step, of preheating the carrier to about 180° F.

3. An improved method of chromizing a ferritic tube, as set forth in claim 4, wherein the step of applying the coating composition comprises applying approximately 100 gm Cr per linear foot to the carrier.

4. An improved method of chromizing a ferritic tube, as set forth in claim 3, wherein the step of subjecting the carrier to an elevated chromizing temperature comprises heating the carrier to a temperature of about 2200° F.

5. An improved method of chromizing a ferritic tube, as set forth in claim 4, the heating step comprises maintaining the temperature of 2200° F. for about two hours.

6. A method of chromizing a surface of a workpiece, comprising the steps of: (a) forming a solidified form from an aqueous slurry composition, the aqueous slurry composition containing at least about 10% by weight chromium, at least about 12% by weight alumina, and a binder of ammonium alginate, said chromium being present in an amount sufficient to provide about 0.3 to about 2.0 grams of chromium per square inch of surface to be chromized; (b) curing the solidified form; (c) positioning the solidified form and a halide activator adjacent the surface to be chromized; and (d) then heating the solidified form and the workpiece in a controlled environment at a temperature of about 2000° F. for about one hour.

7. A method of chromizing a surface of a workpiece, as set forth in claim 6 wherein the chromium is less than or equal to 100 mesh electrolytic grade chromium, the alumina is less than or equal to 100 mesh tabular alumina, and the halide activator is a member selected from the group consisting of ammonium chloride or ammonium bromide.

8. A method of chromizing a surface of a workpiece, as set forth in claim 6, wherein the curring step comprises heating the solidified form to a temperature between approximately 150° F. and 250° F. for a period of at least about two hours, and cooling the heated solidified form to about room temperature.

9. A method of chromizing a surface of a workpiece, as set forth in claim 6 wherein the forming step includes premixing the binder and water and then blending the chromium, alumina and a halide activator into the mixed solution of binder and water.

10. An improved method of chromizing a workpiece, comprising the steps of:

providing a ceramic carrier;

applying an aqueous coating composition to the carrier, the coating composition comprising chromium particles which are to be diffused into the workpiece;

positioning the chromium containing carrier proximate the workpiece; and subjecting the carrier and the workpiece to an elevated chromizing temperature to diffuse the chromium particles into the workpiece.

11. An improved method of chromizing an workpiece, as set forth in claim 10, further comprising the step, prior to said positioning step, of preheating the ceramic carrier to about 180° F.

12. An improved method of chromizing a workpiece, as set forth in claim 11, wherein the step of applying the coating composition comprises applying approximately 100 gm chromium (Cr) per linear foot to the carrier.

13. An improved method of chromizing a workpiece, as set forth in claim 12, wherein the step of subjecting the carrier to an elevated chromizing temperature comprises heating the carrier to a temperature of about 2200° F.

14. An improved method of chromizing a workpiece, as set forth in claim 13, wherein the heating step comprises maintaining the temperature of 2200° F. for about two hours.

15. An improved method of chromizing a workpiece, as set forth in claim 10, wherein the ceramic carrier is made from alumino-silicate fibers.

16. An improved method of chromizing a workpiece, as set forth in claim 15, wherein the positioning step includes placing the chromium containing carrier on the workpiece for coating an exterior surface thereof.

17. An improved method of chromizing a workpiece, as set forth in claim 15, wherein the positioning step includes placing the chromium containing carrier in the workpiece for coating an interior surface thereof.

* * * * *